US010662668B1

(12) United States Patent
Hansen et al.

(10) Patent No.: US 10,662,668 B1
(45) Date of Patent: May 26, 2020

(54) INSECT REPELLANT TENT

(71) Applicants: Kim Hansen, Allardt, TN (US); Demian Nelson, Allardt, TN (US)

(72) Inventors: Kim Hansen, Allardt, TN (US); Demian Nelson, Allardt, TN (US)

( * ) Notice: Subject to any disclaimer, the term of this patent is extended or adjusted under 35 U.S.C. 154(b) by 0 days.

(21) Appl. No.: 16/276,900

(22) Filed: Feb. 15, 2019

(51) Int. Cl.

| | |
|---|---|
| ***E04H 15/36*** | (2006.01) |
| ***E04H 15/02*** | (2006.01) |
| ***E04H 15/54*** | (2006.01) |
| ***A47C 29/00*** | (2006.01) |

(52) U.S. Cl.
CPC ..... *E04H 15/54* (2013.01); *A47C 29/006* (2013.01); *E04H 15/02* (2013.01); *E04H 15/36* (2013.01)

(58) Field of Classification Search
CPC ..... E04H 15/02; E04H 15/36
USPC ..... 135/124; 4/498
See application file for complete search history.

(56) References Cited

U.S. PATENT DOCUMENTS

| | | | | | |
|---|---|---|---|---|---|
| 3,683,427 | A * | 8/1972 | Burkholz | E04H 4/108 | 4/499 |
| 4,017,731 | A * | 4/1977 | Howell | G01V 5/06 | 250/253 |
| 4,136,408 | A * | 1/1979 | Dahlbeck | A01G 9/16 | 4/498 |
| 4,918,877 | A * | 4/1990 | Dutka | E04H 15/20 | 285/239 |
| 5,690,133 | A * | 11/1997 | Capwell | B63B 17/02 | 135/124 |
| 6,062,243 | A * | 5/2000 | Tuch | B63B 17/02 | 135/123 |
| 6,487,734 | B1 * | 12/2002 | First | E04H 4/108 | 4/498 |
| 6,715,168 | B2 | 4/2004 | Williams | | |
| 7,921,863 | B2 | 4/2011 | Ways | | |
| 8,028,352 | B1 * | 10/2011 | Heman | E04H 4/108 | 4/498 |
| 2003/0046755 | A1 * | 3/2003 | Hingle | E04H 4/14 | 4/498 |
| 2004/0107491 | A1 * | 6/2004 | Publicover | E04H 4/0018 | 4/498 |
| 2005/0108817 | A1 * | 5/2005 | Wilson | E04H 4/108 | 4/498 |

* cited by examiner

*Primary Examiner* — Noah Chandler Hawk
(74) *Attorney, Agent, or Firm* — Sanchelima & Associates, P.A.; Christian Sanchelima, Esq.; Jesus Sanchelima, Esq.

(57) ABSTRACT

The present invention relates to an insect repellant tent. The an insect repellant tent comprises a frame structure comprising a base ring comprised to a plurality of ring sections, a plurality of poles connectable to the plurality of ring sections, a plurality of connectors for connecting the plurality of ring sections with the plurality of poles, wherein the connector comprises a connector means and a handle means, wherein the connector means is configured to receive the plurality of ring sections, the pole, and the handle section, a top cap to which the plurality of poles connect while extending from the plurality of connectors, wherein the plurality of ring sections, the top cap, the plurality of poles, and the plurality of connectors define a dome like structure in an assembled configuration thereof. The tent further comprises at least one floatation means provided on the plurality of ring sections, and an insect repellant sheet for covering frame structure.

13 Claims, 9 Drawing Sheets

INSECT REPELLANT TENT

BACKGROUND OF THE INVENTION

1. Field of the Invention

The present disclosure relates to field of tents. In particular, the present invention relates to tents that can remain afloat on water.

2. Description of the Related Art

Sunbathing or just relaxing in the pool or any other water body is one of the most effective and fun recreational activity for reducing stress levels that come with the modern lifestyle. However, this relaxing experience is more often than not interrupted by the bugs like flies or mosquitoes. This is not desired.

Several designs of relaxation structures with insect repelling means have been designed in the past. None of them, however, are known to have a simple configuration with means that allow the structure to remain afloat on the water body such as, for example, a swimming pool.

Applicant believes that a related reference corresponds to U.S. Pat. No. 7,921,863 filed by DAVID EDWARD WAYS. The Ways reference discloses a self-supporting, high-profile, insect net enclosure made of a fabric membrane that defines an interior rectangular space having two side walls, two end walls, a floor and ceiling with advanced insect protection properties, enhanced comfort, accessibility, ventilation, and lightweight storage characteristics. However, the Ways reference fails to disclose any means for allowing the enclosure remain afloat on water.

Another related application is U.S. Pat. No. 6,715,168 filed by TROY EUGENE WILLIAMS. The Williams reference discloses a mosquito net frame having a rectangular top frame portion of the mosquito net frame is realized by easily assembling square tubes or rods and fittings together. However, the Williams reference fails to disclose any means for allowing the enclosure remain afloat on water.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an insect repellant tent that allows a user to relax in a body of water without the disturbances of bugs.

It is yet another object of the present invention to provide an insect repellant tent that can remain afloat on water.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
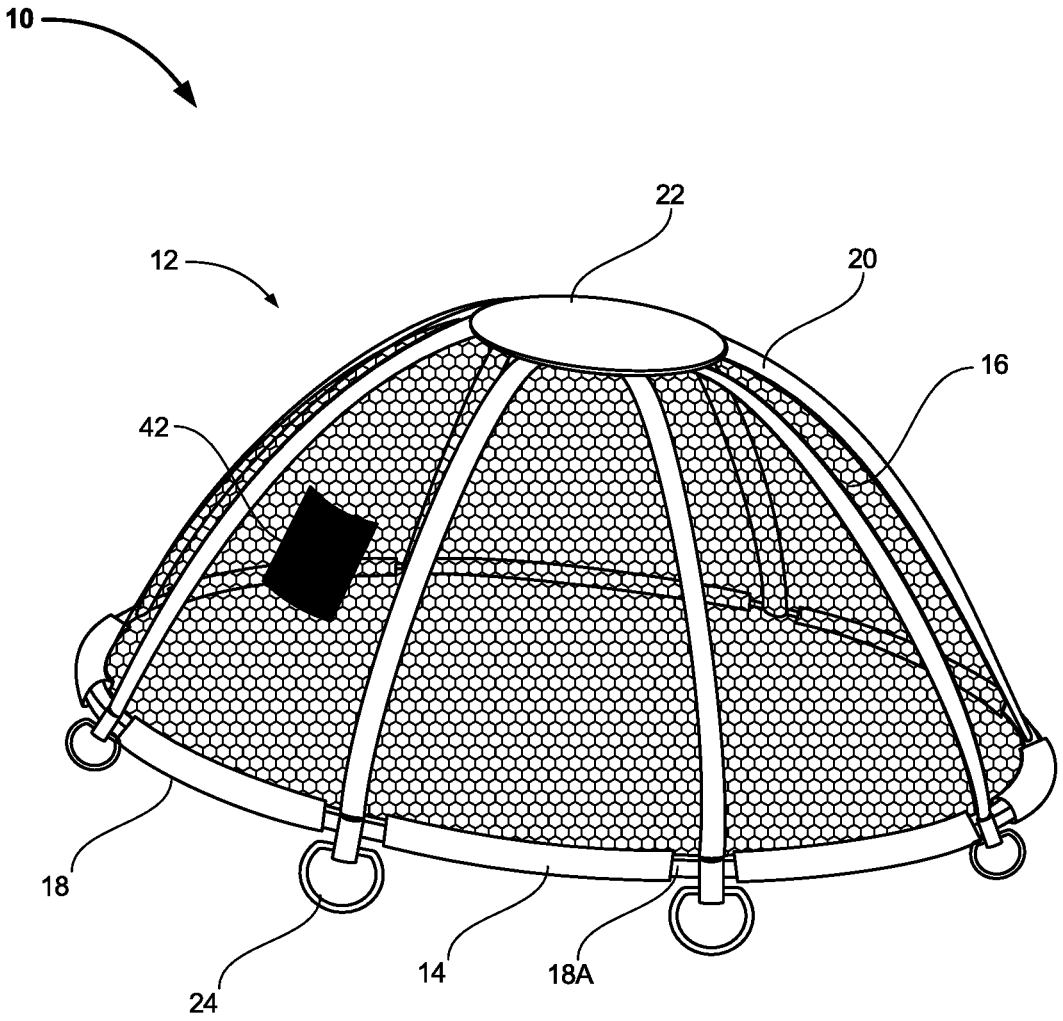
FIG. 1 illustrates an isometric view of an insect repellant tent 10, in accordance with an embodiment of the present invention, wherein the insect repellant tent comprises a frame structure 12, floatation means 14 provided on the frame structure, and an insect repellant sheet 16 provided on the frame structure 12.
Figure 2:
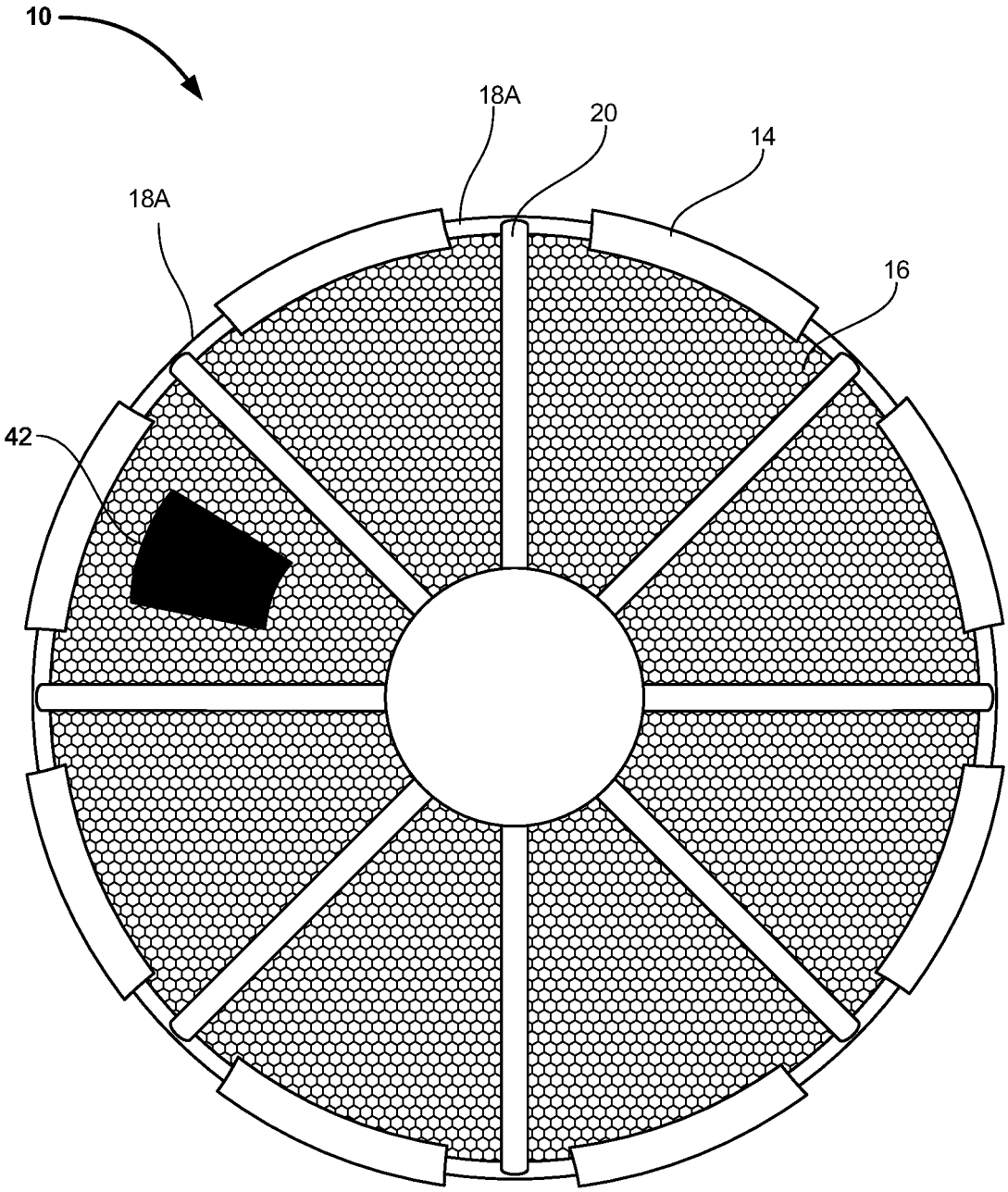
FIG. 2 illustrates a top view of the insect repellant tent 10, in accordance with an embodiment of the present invention, wherein a plurality of poles 20 are seen extending from a base ring 18 and will intersect and be stabilized in place by the top cap 22.
Figure 3:
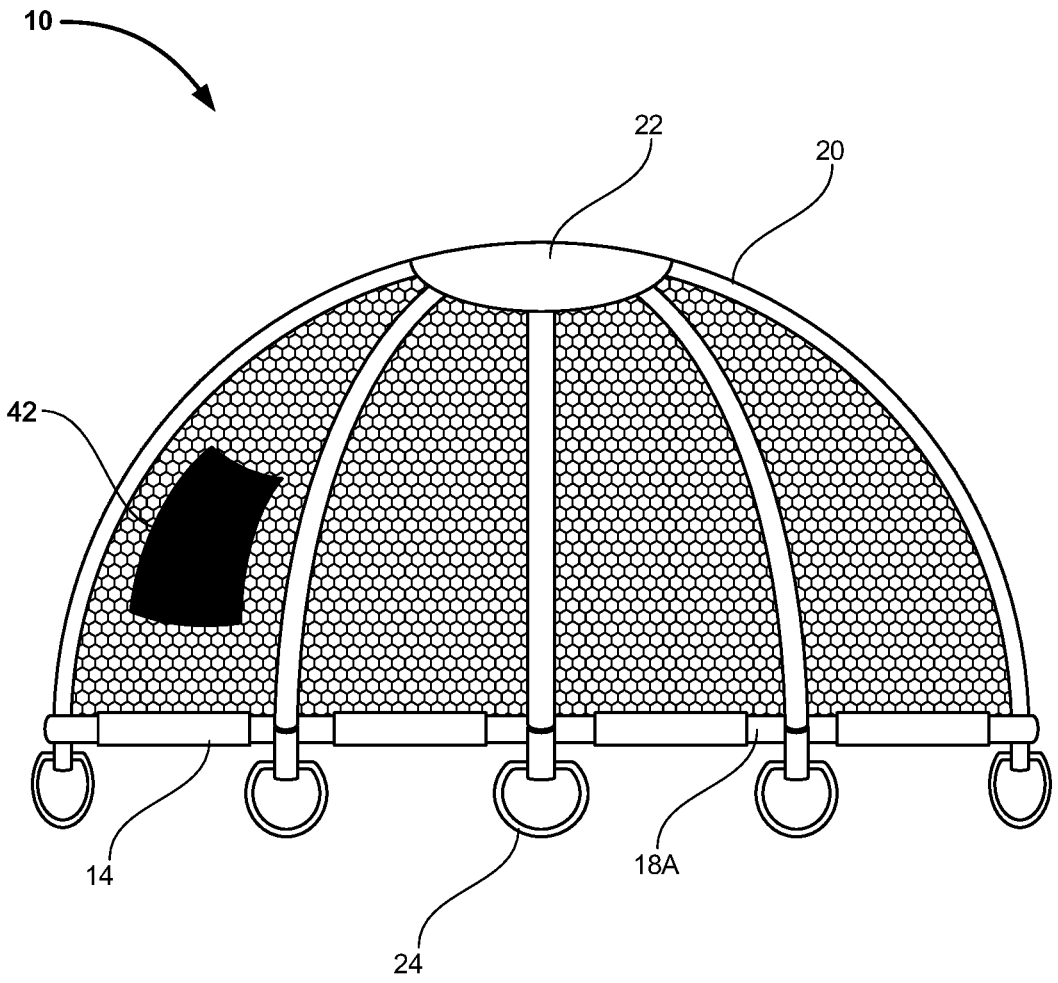
FIG. 3 illustrates a side view of the tent 10, in accordance with an embodiment of the present invention.
Figure 4:
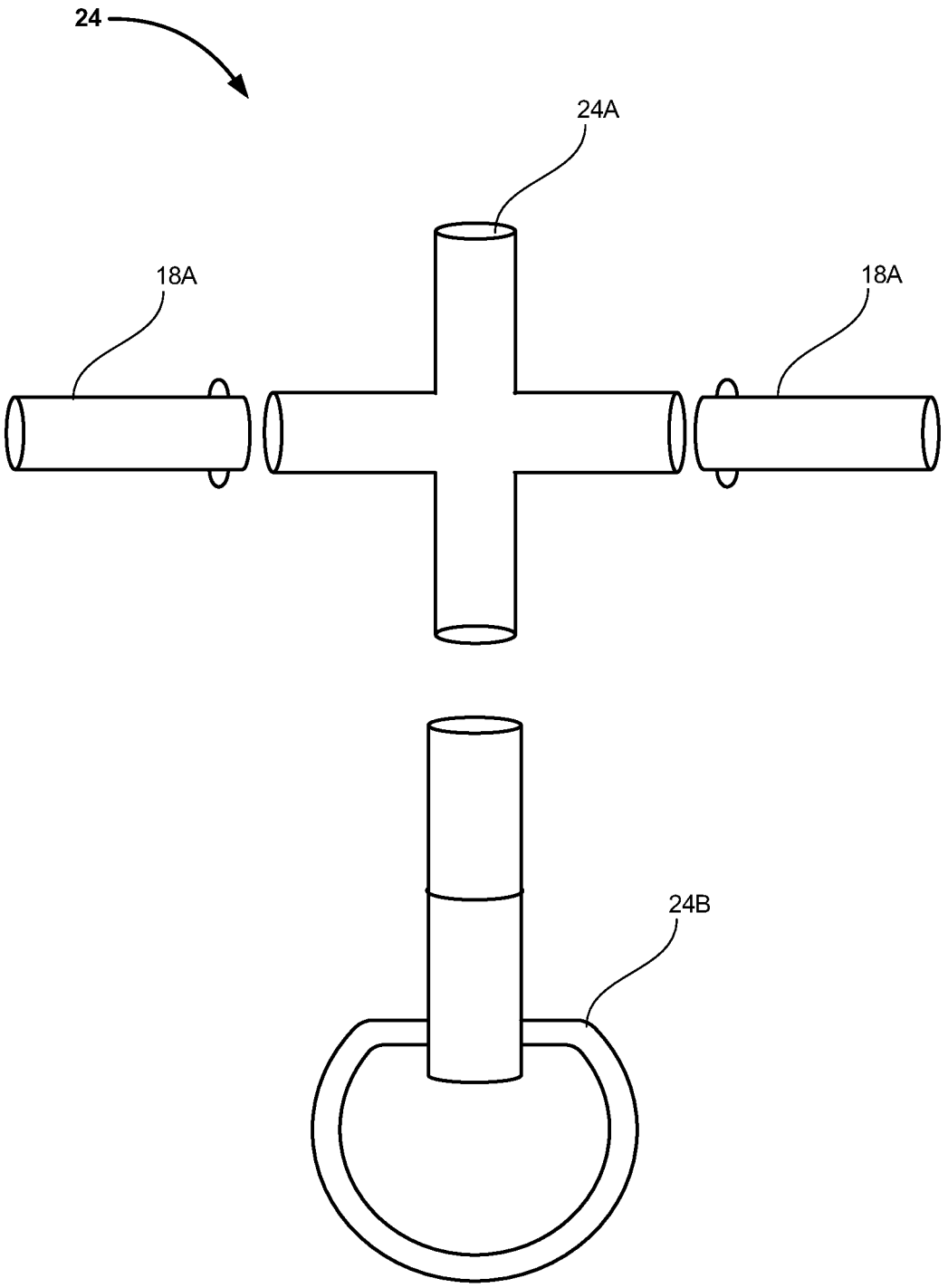
FIG. 4 illustrates schematic view of a connector 24, in accordance with an embodiment of the present invention.

Referring now to FIGS. 1-9, where the present invention is generally referred to with numeral 10, it can be observed that an insect repellant tent 10 (hereinafter referred to as tent 10), in accordance with an embodiment of the present invention, comprises a frame structure 12, floatation means 14 provided on the frame structure, and an insect repellant sheet 16 provided on the frame structure 12.

The frame structure 12 comprises a base ring 18. The base ring 18 is defined by a plurality of ring sections 18A that are assembled together to form the base ring 18. The frame structure 12 further comprises a plurality of poles 20. The plurality of poles 20 are configured to extend from the base ring 18 and terminate into a top cap 22.

The top cap 22 is provided at an operative top portion of the tent 10. The top cap 22 can be made of a rigid or a semi-rigid material. More specifically, the top cap 22 can include pockets in which the plurality of poles 20 are received. The base ring 18, the poles 20, and the top cap 22 are assembled to define the frame structure 12, which has a dome-like configuration.

In one embodiment, the top cap 22 and base can have a high visibility color for safety in open water bodies. In another embodiment, the poles 20 will intersect at the top cap 22 of the tent 10. The top cap 22, in accordance with one exemplary embodiment, has a type of memory foam in it that sandwiches above and below the poles 20 and clamp together to stabilize the poles 20 while still allowing some movement.

The frame structure 12 further comprises a plurality of connectors 24. Reference is hereinafter directed to FIG. 4. The connectors 24 facilitate the connection between the ring sections 18A and the poles 20. More specifically, the connectors 24 include a connector section 24A and a handle section 24B. The connector section 24A can have a T shaped configuration. The longitudinal extensions of the connector section 24A are configured to receive the ring sections 18A, whereas the transverse extension of the connection section 24A is configured to receive the pole 20.

The tent 10 further comprises the floatation means 14. The floatation means 14 are provided on the ring sections 18A. The floatation means 14 can be inflatable pool noodles or pool noodles made of foam and having a hollow configuration to receive the ring sections 18A therewithin.

The tent 10 further comprises the insect repellant sheet 16. The insect repellant sheet 16 can be configured to cover the frame structure 12. In another embodiment, the insect repellant sheet 16 can be configured to cover the spaces formed between the two poles 20, where the poles 20 are assembled on the base ring 18. The insect repellant sheet 16, in accordance with one embodiment, can be a meshed sheet. In another embodiment, the meshed sheet can be either metallic or non-metallic.

In another embodiment, the insect repellant sheet 16 need not be a meshed sheet. The insect repellant sheet 16 can be any conventionally known sheet being used in tents. The insect repellant sheet 16 can also be configured to protect the user from sunlight while the user is relaxing outdoors, either in the water body or out of it. The insect repellant sheet 16 can be assembled onto the frame structure 12 via hook and loop straps or C-clamps. The tent 10 further comprises at least one pocket 42 configured on the inner walls of the insect repellant sheet 16 for storing items such as eyewear, sunscreen lotion, and the like.

The tent 10 can be configured to accommodate anywhere from one to ten or more occupants therewithin. The tent 10 is not restricted to be used in just water bodies. The configuration of the tent 10 allows it to be used on land as well. In an embodiment, all the components of the tent 10 can be carried into duffle bags. These components can be easily assembled on the location where the user wishes to relax.

Figure 5:
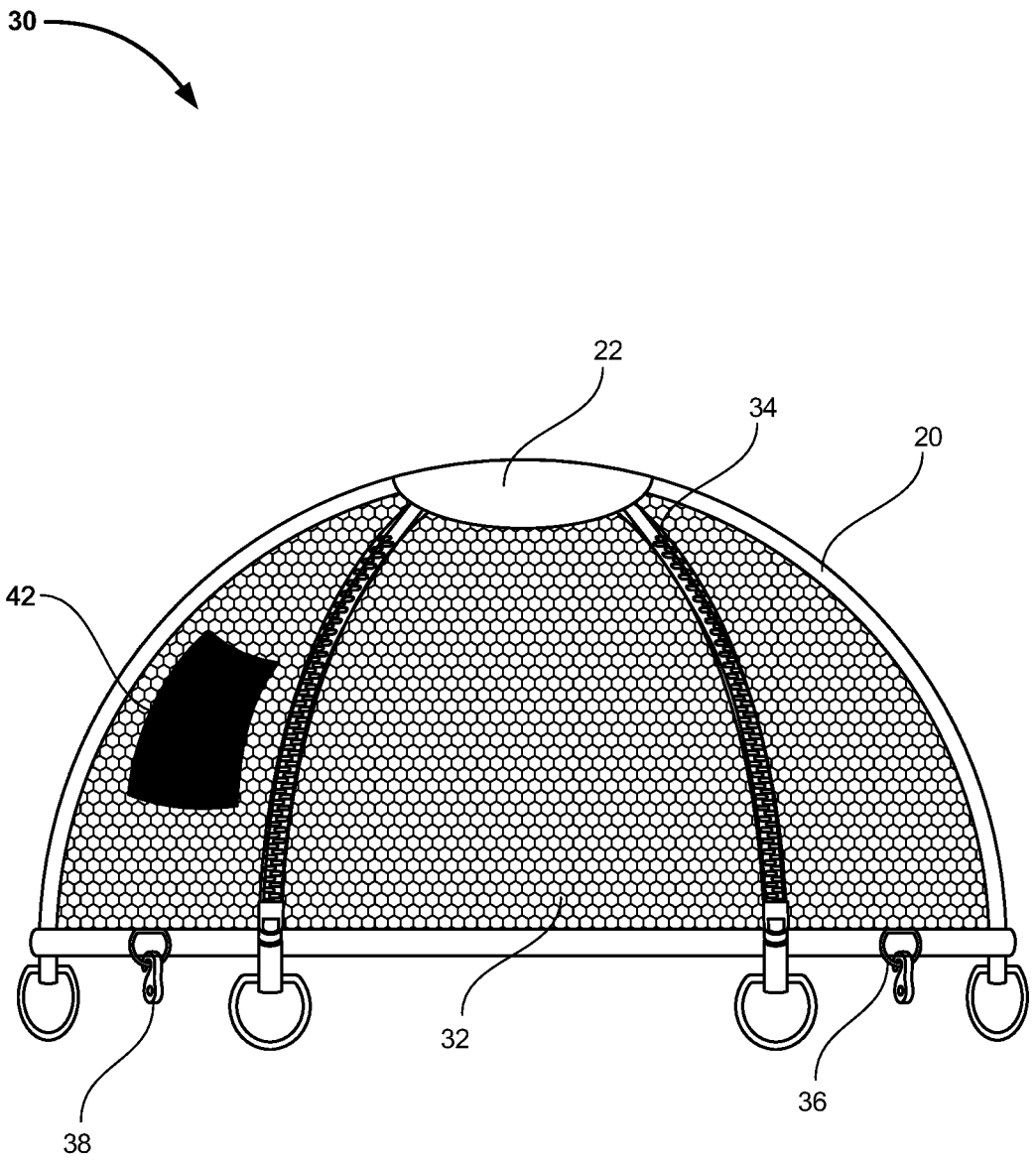
FIG. 5 illustrates a front view of a tent 30, in accordance with an embodiment of the present invention, wherein the tent 30 comprises a door flap 32, fastening means 34, and clamps 36, and wherein the tent 30 is configured to be used on land.
Figure 6:
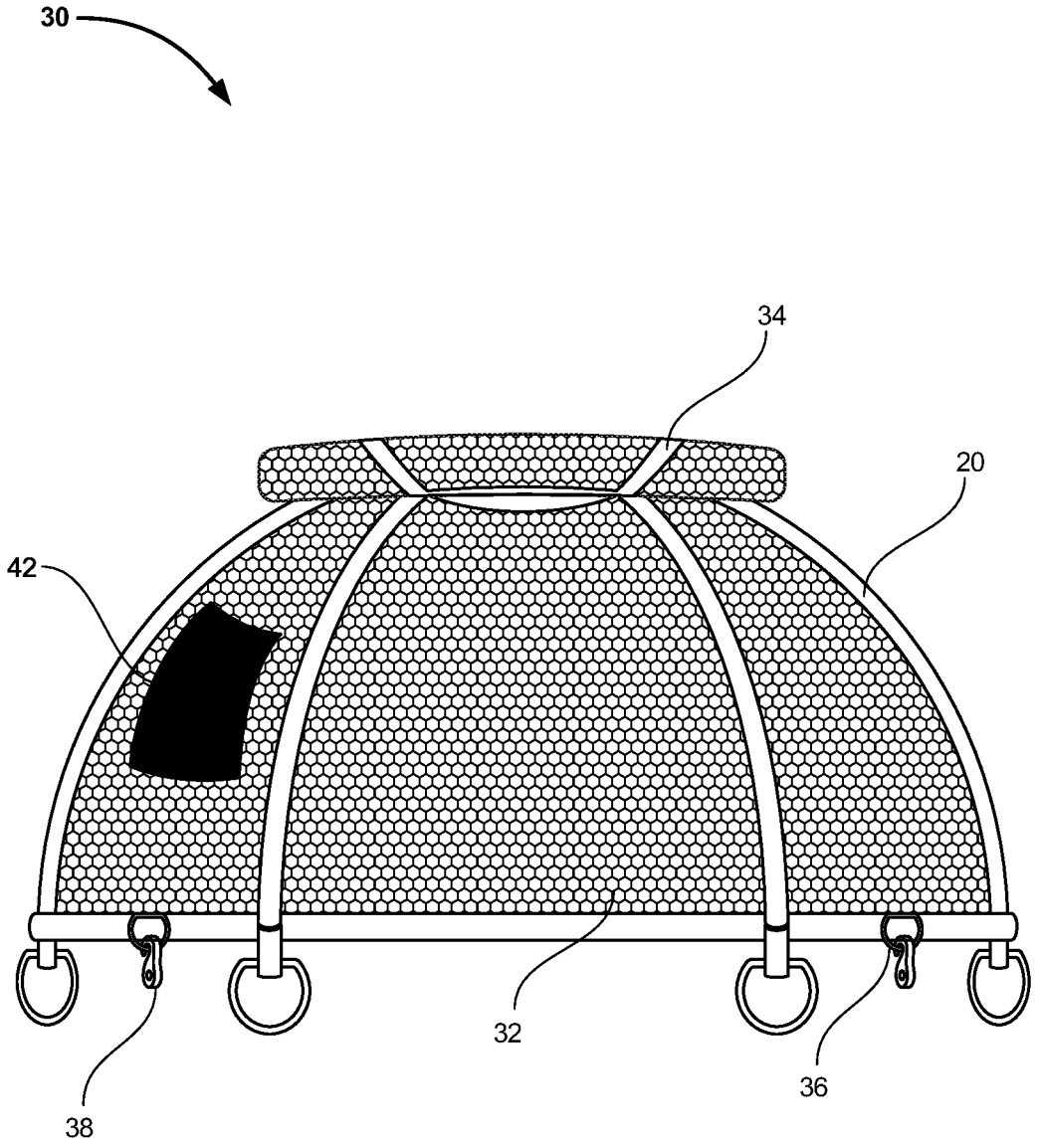
FIG. 6 illustrates another front view of a tent 30, in accordance with an embodiment of the present invention, wherein the door flap 32 is in its open configuration.

Another embodiment of a tent is illustrated in FIGS. 5 and 6. The tent 30, illustrated in FIGS. 5 and 6 has a similar configuration to that of the tent 10. The difference being that tent 30 is configured for use on ground instead of a water body. As such, similar components of the tent 10 and tent 30 are referenced by like numerals, and their description is not repeated herein for the sake of brevity of the present disclosure.

As mentioned previously, the tent 30 is configured to be used on ground as a portable tent, the type usable for camping. The tent 30 comprises a door flap 32 and fastening means 34. The fastening means 34 facilitate the opening and closing of the door flap 32 for providing an entry or exit into or out of the tent 30. In the present embodiment, the fastening means 34 are zippers. Other embodiments of the fastening means 34 include but are not limited to magnetic clamps, hook and loop straps, and the like.

The tent 30 further comprises clamps 36 attached to each sector of the insect repellant sheet 16. Floatation means 14 are not required in the tent 30, as tent 30 is designed for use on land. The clamps 36 are designed to be engaged with hooks 38, wherein the hooks 38 can be tied to support means that are supported on the ground.

Figure 7:
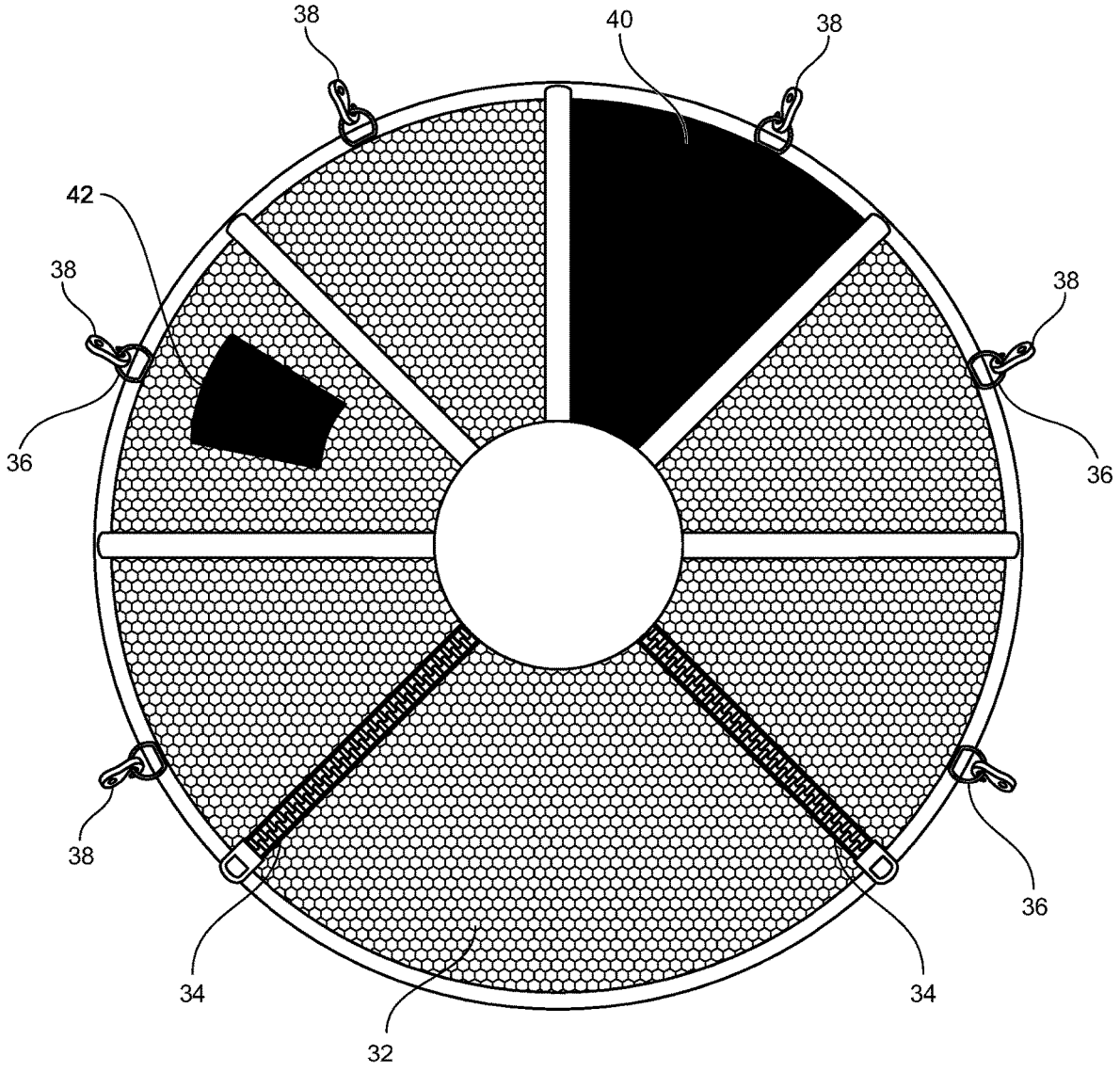
FIG. 7 illustrates a top view of the tent 30, in accordance with an embodiment of the present invention, wherein a portion of the tent 30 includes a sunscreen sheet 40.

Another embodiment of the tent 30 is illustrated in FIG. 7. The tent 30 comprises a sunscreen sheet 40. The feature of the sunscreen sheet 40 can also be added to the tent 10. The sunscreen sheet 40 can be affixed over the insect repellant sheet 16. In an embodiment, the sunscreen sheet 40 can be affixed over the insect repellant sheet 16 via hook and loop straps or magnetic coupling.

The outer most surface of the tents 10, 30, whether it be the insect repellant sheet 16 or the sunscreen sheet 40, can be provided with aesthetic patterns configured thereon. The aesthetic patterns include, but are not limited to, logos, abstracts, cartoons, written text, and the like.

Figure 8:
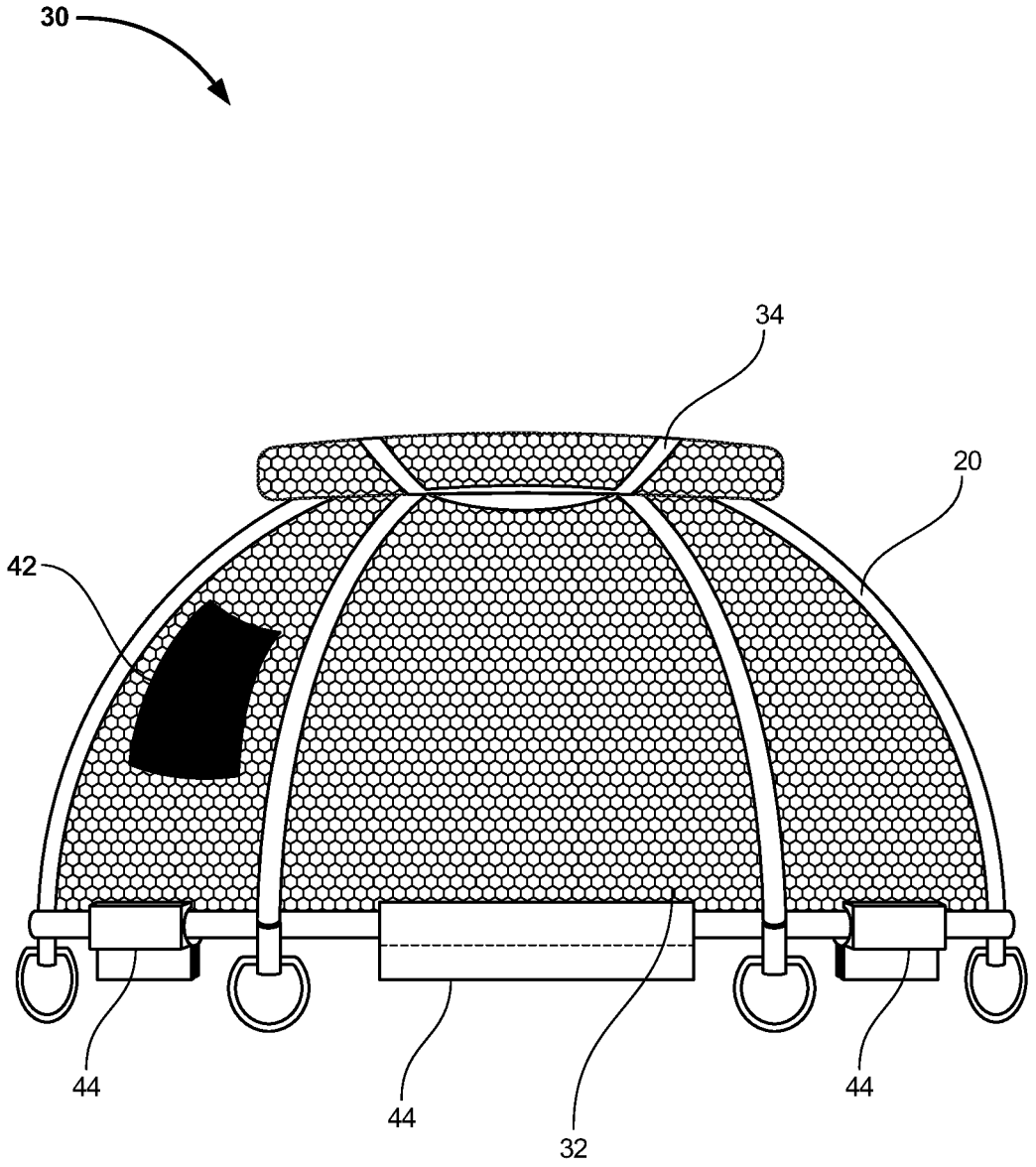
FIG. 8 illustrates a front view of the tent 30, in accordance with yet another embodiment, wherein the tent 30 includes a plurality of mounts 44 that facilitate the mounting of the tent 30 on an aboveground water pool.
Figure 9:
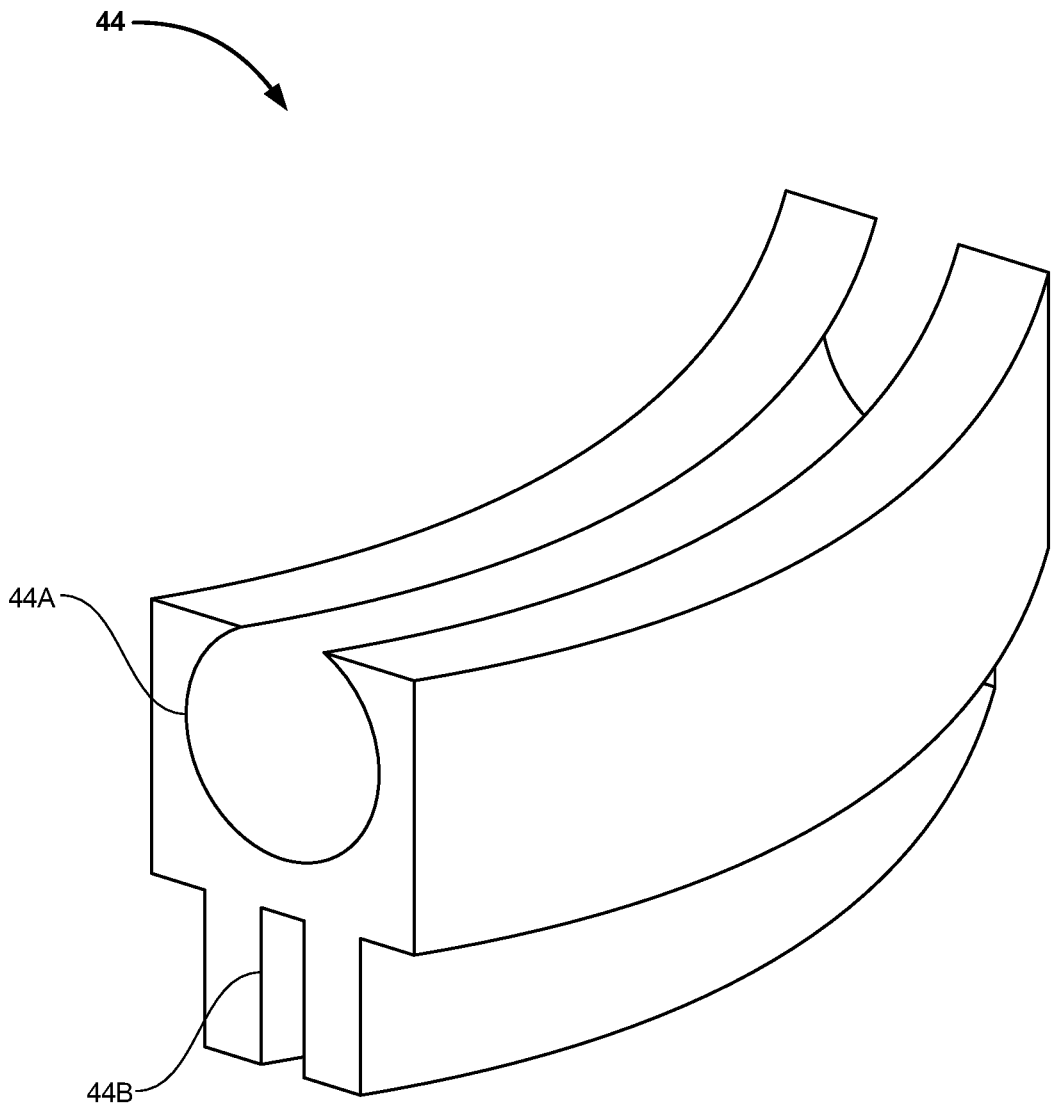
FIG. 9 illustrates an isometric view of a mount 44, in accordance with an embodiment of the present invention.

FIG. 8 illustrates a front view of the tent 30, in accordance with yet another embodiment, wherein the tent 30 includes a plurality of mounts 44 that facilitate the mounting of the tent 30 on an aboveground water pool. All the elements in the tents 30 illustrated in FIG. 6 and FIG. 9 are alike, with the exception being the inclusion of the plurality of mounts 44 instead of the clamps 36 and hooks 38. As such, the description of the like elements is not repeated herein for the sake of brevity of the present disclosure. Furthermore, like elements in the tents 30 illustrated in FIGS. 6 and 9 are referred by like numerals for the sake of simplicity.

FIG. 9 illustrates an isometric view of a mount 44 from the plurality of mounts 44, in accordance with an embodiment of the present invention. Referring to FIGS. 8 and 9, the mounts 44 can be connected to the ring sections 18A. More specifically, a first slot 44A of the mount 44 is configured to accommodate the ring section 18A therewithin. A second slot 44B is provided on the mount 44 to connect to a periphery of an aboveground water pool. The configuration of the second slot 44B can be varied to be complementary to the periphery of the aboveground pool.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An insect repellant tent comprising:

a. a frame structure including a base ring defined by a plurality of ring sections, a plurality of poles that extend from said base ring to a top cap located at an operative top portion of said frame structure, a plurality of connectors provided along said base ring, wherein said plurality of connectors each include a connector section and a handle section mounted to said connector section, wherein said connector section has a cross shaped configuration having vertical tubing and horizontal tubing, wherein said horizontal tubing receives said plurality of ring sections, wherein said vertical tubing includes an upper end which receives said plurality of poles, wherein said vertical tubing includes a bottom end which receives said handle section, wherein said handle section includes a ring member mounted thereon;

b. at least one floatation member coupled to said base ring; and c. an insect repellant sheet for covering frame structure.

2. The insect repellant tent according to claim 1, wherein the plurality of ring sections, the top cap, the plurality of poles, and the plurality of connectors define a dome like structure in an assembled configuration thereof.

3. The insect repellant tent according to claim 1, wherein the insect repellant sheet is a mesh sheet.

4. The insect repellant tent according to claim 3, wherein the mesh sheet is at least one of a metallic mesh sheet or a non-metallic mesh sheets.

5. The insect repellant tent according to claim 1 wherein said insect repellant sheet includes a door flap being triangular in shape defining a section of said insect repellant sheet.

6. The insect repellant tent according to claim 1 including a sunscreen sheet mounted over said insect repellant sheet.

7. The insect repellant tent according to claim 1 including at least one pocket located along inner walls of said insect repellant sheet configured to store items therein.

8. An insect repellant tent comprising:

a. a frame structure comprising:

i. a base ring comprised of a plurality of ring sections;

ii. a plurality of poles connectable to the plurality of ring sections;

iii. a plurality of connectors for connecting the plurality of ring sections with the plurality of poles, wherein said plurality of connectors each include a connector section and a handle section mounted to said connector section, wherein said connector section has a cross shaped configuration having vertical tubing and horizontal tubing, wherein said horizontal tubing receives said plurality of ring sections, wherein said vertical tubing includes an upper end which receives said plurality of poles, wherein said vertical tubing includes a bottom end which receives said handle section, wherein said handle section includes a ring member mounted thereon;

iv. a top cap to which the plurality of poles connect while extending from the plurality of connectors;

v. wherein the plurality of ring sections, the top cap, the plurality of poles, and the plurality of connectors define a dome like structure in an assembled configuration thereof b. at least one floatation member provided on the plurality of ring sections; and c. an insect repellant sheet for covering frame structure.

9. An insect repellant tent comprising:

a. a frame structure comprising:

i. a base ring comprised of a plurality of ring sections;

ii. a plurality of poles connectable to the plurality of ring sections;

iii. a plurality of connectors for connecting the plurality of ring sections with the plurality of poles, wherein said plurality of connectors each include a connector section and a handle section mounted to said connector section, wherein said connector section has a cross shaped configuration having vertical tubing and horizontal tubing, wherein said horizontal tubing receives said plurality of ring sections, wherein said vertical tubing includes an upper end which receives said plurality of poles, wherein said vertical tubing includes a bottom end which receives said handle section, wherein said handle section includes a ring member mounted thereon;

iv. a top cap to which the plurality of poles connect while extending from the plurality of connectors;

v. wherein the plurality of ring sections, the top cap, the plurality of poles, and the plurality of connectors define a dome like structure in an assembled configuration thereof b. an insect repellant sheet for covering frame structure;

c. at least one clamp provided on the insect repellant sheet for affixing to the base ring.

10. The insect repellant tent according to claim 9, comprising a door flap and a fastening member for opening and closing the door flap.

11. The insect repellant tent according to claim 10, wherein the fastening member is one or more zippers.

12. The insect repellant tent according to claim 9 wherein at least one mount is provided on the plurality of ring sections for mounting the tent on an aboveground water pool.

13. The insect repellant tent according to claim 12, wherein each mount of the plurality of mounts includes:

a. a first slot configured to accommodate the ring section, wherein said first slot is circular in shape and includes a cut portion at a top end; and b. a second slot having a configuration complementary to a periphery of the aboveground water pool for facilitating the mounting of the tent on the aboveground water pool, wherein said second slot is located directly below said first slot, wherein said first slot is a rectangular opening.

* * * * *